US010597859B2

(12) United States Patent
Hennessy et al.

(10) Patent No.: US 10,597,859 B2
(45) Date of Patent: Mar. 24, 2020

(54) DEDICATED SIPHON JET TOILET AND ENHANCED VACUUM FLUSH SYSTEM FOR THE SAME

(71) Applicant: Falcon Waterfree Technologies, LLC, Los Angeles, CA (US)

(72) Inventors: Philip Hennessy, Frankford (CA); Edward Michael Goldsmith, Encino, CA (US)

(73) Assignee: Falcon Waterfree Technologies, LLC, Los Angeles, CA (US)

( * ) Notice: Subject to any disclaimer, the term of this patent is extended or adjusted under 35 U.S.C. 154(b) by 0 days.

(21) Appl. No.: 15/014,002

(22) Filed: Feb. 2, 2016

(65) Prior Publication Data

US 2016/0356032 A1 Dec. 8, 2016

Related U.S. Application Data

(60) Provisional application No. 62/111,080, filed on Feb. 2, 2015.

(51) Int. Cl.
*E03D 1/34* (2006.01)
*E03D 11/02* (2006.01)

(52) U.S. Cl.
CPC ..... *E03D 11/02* (2013.01); *E03D 1/34* (2013.01); *E03D 2201/30* (2013.01)

(58) Field of Classification Search
CPC ..... E03D 1/34
(Continued)

(56) References Cited

U.S. PATENT DOCUMENTS 6,715,162 B2 * 4/2004 Han ..... E03D 1/34 4/378
6,728,975 B2 * 5/2004 Han ..... E03D 1/34 4/324

(Continued)

FOREIGN PATENT DOCUMENTS

JP 05-044242 2/1993
JP 05-339969 12/1993

(Continued)

OTHER PUBLICATIONS

International Search Report of the International Searching Authority for PCT/US2016/016231; dated May 19, 2016.
Written Opinion of the International Searching Authority for PCT/US2016/016231; dated May 19, 2016.

(Continued)

*Primary Examiner* — Lori Baker
(74) *Attorney, Agent, or Firm* — Tope-McKay & Associates

(57) ABSTRACT

A device for the disposal of human waste matter, specifically a toilet, is presented. This toilet incorporates elements designed to prevent both a loss of flushing efficiency and an extensive consumption of water, all while improving upon the basic functionalities of the toilet as such. These elements include specialized parts designed to both improve the efficacy of the "siphon jet" type toilet by precluding the possibility of aeration within certain critical components of the toilet system proper, as well as a specialized rim fed channel whose intersection of the filled jet channel always travels below the operating water level of the bowl, and a vacuum assisted flushing system, whose primary purpose is to enhance the power of the toilet's flushing action.

8 Claims, 8 Drawing Sheets

(58) Field of Classification Search
USPC ..... 4/378–384
See application file for complete search history.

(56) References Cited

U.S. PATENT DOCUMENTS

| | | | | |
|---|---|---|---|---|
| 6,901,610 | B1 * | 6/2005 | Jensen | E03D 1/34 4/324 |
| 8,266,733 | B2 * | 9/2012 | Jensen | E03D 1/306 4/378 |
| 2008/0052812 | A1 * | 3/2008 | Jensen | E03D 1/304 4/378 |
| 2010/0251471 | A1 * | 10/2010 | Cadavid Gonz Lez | E03D 11/08 4/378 |
| 2014/0059755 | A1 * | 3/2014 | Garrels | E03D 5/003 4/363 |
| 2015/0013058 | A1 * | 1/2015 | Bucher | E03D 9/035 4/378 |

FOREIGN PATENT DOCUMENTS

| | | |
|---|---|---|
| JP | 09-177159 | 7/1997 |
| JP | 2002-061252 | 2/2002 |
| JP | 2004-108052 | 4/2004 |

OTHER PUBLICATIONS

Abstract translations for the Japanese documents.
Notification of International Preliminary Report on Patentability for PCT/US2016/016231; dated Aug. 17, 2017.
International Preliminary Report on Patentability for PCT/US2016/016231; dated Aug. 17, 2017.

* cited by examiner

DEDICATED SIPHON JET TOILET AND ENHANCED VACUUM FLUSH SYSTEM FOR THE SAME

CROSS-REFERENCE TO RELATED APPLICATION

This application claims the benefit of U.S. Provisional Application No. 62/111,080, filed Feb. 2, 2015, titled "Push-pull."

BACKGROUND OF THE INVENTION (1) Field of Invention

The present invention relates to a device for the disposal of human waste matter, specifically a toilet. The invention features a series of improvements upon the common "siphon jet" design.

(2) Description of Related Art

Within the field of sewage and sanitation, the toilet featuring a direct channel from the flush valve into a siphon jet is a well-known improvement upon previous designs. This is so by virtue of the addition of this dedicated channel, whose primary function is to feed water into a jet in the well of a toilet. Such a configuration has been demonstrated to assist in removing more waste than was possible with previous configurations, while using less water.

In contrast to the siphon jet system, the vast majority of flush valves found in toilets consist of a simple flapper or some other kind of valve that controls the flow of flushing water. Such a mechanism is generally combined with an overflow tube, which provides a direct feed from the tank to the toilet bowl, and which thus prevents tank overflow in the event that the tank's filling valve fails to form a complete seal subsequent to flushing. In this conventional type of configuration the overflow tube's connection to the toilet bowl is generally two-fold; in the first instance, the overflow tube is routed directly into the siphon jet, while a secondary, diverted flow feeds into a rim feed channel, also known a an overflow channel. The overflow channel is also in part responsible for refilling the toilet pan after each flush.

Additionally, in this standard sort of configuration, the overflow tube is open to the atmosphere. Consequently, any channels connected to the overflow tube below the flush valve within the toilet bowl, including a siphon jet, will be partially aerated, usually at a point above the bowl's water spot surface. The "air pockets" so formed cannot be entirely removed until well into the flushing cycle, if at all, as water entering the interconnected piping fights to move in the opposite direction of the trapped air that is simultaneously exiting the system. The loss of energy and velocity of the water entering the bowl is the result of this dynamic, wherein trapped air is forced to push in at least two directions. On the one hand, the air will force itself downwards, out of the jet channel itself; on the other, the air will disperse upwards from the gap in the jet channel, which in conventional toilets, will unavoidably exist between the flush valve and the resting water spot level.

In an effort to reduce water use, toilet manufacturers have begun to use larger sized flush valves, often three inches in diameter or more, in order to speedup the flow of water. Such a measure, however, can at best partially ameliorate the abovementioned problems with regards to the conventional siphon jet configuration as described. Accordingly, the present invention describes a way to increase head pressure within the common siphon jet toilet system, thereby retaining what would otherwise be, with a conventional system, an unavoidably higher expenditure of energy, water and time.

SUMMARY OF INVENTION

The present invention relates to a device for the disposal of human waste matter, specifically a toilet. The invention features a series of improvements upon the common "siphon jet" design. Specifically, in one aspect, the invention teaches a siphon jet toilet with a bowl having a rim and an operating water level. A jet channel resides in fluid communication with the bowl and is configured to be in fluid communication with a tank and to remain filled with flushing fluid both when the toilet is being flushed and when the toilet is at rest. A rim channel resides in fluid communication with the jet channel to provide fluid therefrom to the upper and inner edge of the bowl, where at least a portion of the rim channel remains full when the toilet is flushed.

In another aspect, the toilet further comprises an outflow jet having a level and configured to provide fluid to the bowl. The outflow jet is in fluid communication with the rim channel, where a portion of the rim channel travels below the level of the outflow jet.

In yet another aspect, the toilet includes an intersection between the jet channel and the rim channel where the intersection always travels below the operating water level of the bowl when the toilet is flushed and when the toilet is at rest.

In a still further aspect, the toilet includes a trapway in fluid communication with the bowl to allow affluent to exit therefrom. The toilet also includes a vacuum container in fluid communication with the trapway, where the trapway has a water level. The vacuum container is attached with the trapway such that when the flush valve is activated, water simultaneously exits the outflow jet sufficiently to fill the trapway to enable a vacuum seal to be formed between the vacuum container and the water in the trapway, pulling from the trapway.

In a yet further aspect, the toilet further comprises a tank for storing fluid to be introduced through a flush valve into the jet channel, where the vacuum container resides within the tank.

In a further aspect, the toilet further includes a tank and a flush valve connected with the jet channel for opening and closing the jet channel to the tank, where the flush valve resides within the tank. When the toilet is flushed, the flush valve opens to permit the flow of water from the tank into the jet channel. The rim channel is configured such that when the flush valve closes, water remaining in the rim channel above the operating water level of the bowl will flow back toward the jet channel to anther ensure that air does not enter the jet channel at the end of a flush cycle.

In another aspect, the present invention comprises a method for forming a siphon jet toilet comprising series of acts for providing the elements in the aspects described above.

Specifically, in one aspect, the present invention teaches a method for forming a siphon jet toilet comprising an act of providing a bowl having a rim and an operating water level. The method includes a further act of providing a jet channel in fluid communication with the bowl and configured to be in fluid communication with a tank and to remain filled with flushing fluid both when the toilet is being flushed and when the toilet is at rest. The method includes a still further act of providing a rim channel in fluid communication with the jet channel to provide fluid therefrom to the upper and inner edge of the bowl, where at least a portion of the rim channel remains full when the toilet is flushed.

In another aspect, the method further comprises an act of providing an outflow jet having a level and configured to provide fluid to the bowl and in fluid communication with the rim channel, where a portion of the rim channel travels below the level of the outflow jet.

In a still further aspect, the method further comprises an act of providing an intersection between the jet channel and the rim channel where the intersection always travels below the operating water level of the bowl when the toilet is flushed and when the toilet is at rest.

In a yet further aspect, the method further comprises an act of providing a trapway in fluid communication with the bowl to allow affluent to exit therefrom. In this aspect, the method also comprises an act of providing a vacuum container in fluid communication with the trapway, where the trapway has a water level. The vacuum container is attached with the trapway such that when the flush valve is activated water simultaneously exits the outflow jet sufficiently to fill the trapway to enable a vacuum seal to be formed between the vacuum container and the water in the trapway, pulling from the trapway.

In yet another aspect, the method further comprises an act of providing a tank for storing fluid to be introduced through as flush valve into the jet channel, where the vacuum container resides within the tank.

In another aspect, the method further an act of providing a tank and a flush valve connected with the jet channel for opening and closing the jet channel to the tank. The flush valve resides within the tank. When the toilet is flushed, the flush valve opens to permit the flow of water from the tank into the jet channel, with the rim channel configured such that when the flush valve closes, water remaining in the rim channel above the operating water level of the bowl will flow back toward the jet channel to further ensure that air does not enter the jet channel at the end of a flush cycle.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION OF THE INVENTION

Figure 1:
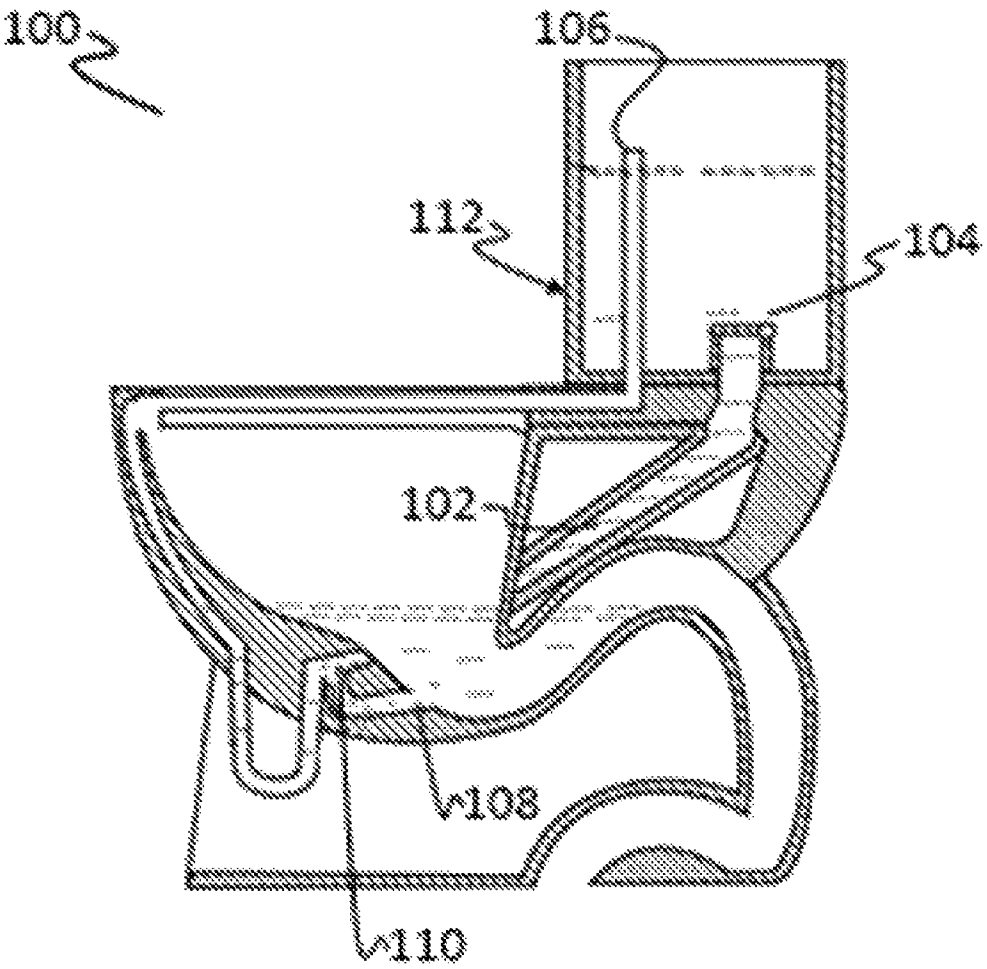
FIG. 1 is a drawing of a toilet per the present invention in a resting state between flushes.

In the following detailed description, numerous specific details are set forth in order to provide a more thorough understanding of the present invention. However, it will be apparent to one skilled in the art, that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

The present invention is exemplified by a number of configurations, and is likewise distinguished from the prior art by setting forth configurations that characterize the same. Accordingly, the present invention builds upon the dedicated siphon jet toilet system by implementing a primed jet channel with increased head pressure. The mechanism whereby this improvement in head pressure is created not only has the net effect of reducing water consumption, but also increases the overall force with which the toilet bowl is evacuated of its contents. Additionally, it also effects a shortened response time between two stages of the flush cycle, where the first of these is had as flush activation, and the second consists of the bowl contents entering the toilet's trapway.

A further cost-reducing benefit and overall enhancement of the system at hand is realized by the implementation of a single flush valve, wherein a single primed channel is divided into two sub-channels. In this further improved configuration, one offshoot channel supplies a jet located at the opening of the trapway. The other offshoot channel travels down below the elevation of the trapway jet, and then upwards again, so as to feed the rim area and wash the bowl. This diverted rim channel must at some point travel at or below the lowest level the water will reach in the bowl during a flush, so as to ensure that no air can enter the system. Notably, the rim is opened to the atmosphere in this configuration, particularly when the flush valve closes and stops the flow of water. Consequently, all water in the rim fed channel above the level of water in the bowl will, in this instant, flows back into the primed jet channel.

This further improvement is necessary, to the extent that it ensures that air cannot enter the primed jet channel at the end of the flush cycle, through the jets' exit point or "outflow jet" in the well of the toilet.

An additional advantage of the improved configuration described herein results from the rim/bowl wash channel's being open to the atmosphere at the top. This is particularly so, insofar as the water level held within the rim/bowl wash channel will always be at the same level as the water in the pan of the bowl at rest prior to flushing. As a result and subsequent to flushing, when the flush valve closes, the water in the top of the rim/bowl wash channel drops rapidly, falling below the level of the water in the pan after the flush. Once this portion of the flush cycle is complete, the water will stabilize itself at an elevation equal to the level in the pan. To ensure no air can enter the primed jet channel from the rim, the rim/bowl wash channel is connected several centimeters below the elevation of the jet hole.

Importantly, the flush valve as configured within the present invention must close at a prescribed water level in the tank to prevent air from entering the primed jet channel. In accordance with this requirement, the flush valve is always under water in the tank.

With conventional toilets, on the other hand, the elevation of water in the jet channel between flushes is equal to the elevation of water in the pan. As already mentioned, this results from the fact that the jet channel is open to the atmosphere by way of the overflow tube that is part of a traditional flush valve, By contrast, the present invention features a separate channel through the housing or body of the toilet. This configuration permits water from a separate refill or overflow tube to flow to the bowl and replenish the required water seal, right at the initial exit point of the jet channel, which is typically two inches in diameter.

The present invention maintains a water and airtight jet channel at the entry point of the jet channel within the toilet, tank. This effect is accomplished by using a flush valve that covers what is known in the art as a "primed" jet channel, which is characterized by its being completely full of water, and thus entirely lacking any air pockets. This advantage is achieved insofar as the improved jet channel in question is not connected to an overflow tube, and is not open to the atmosphere in any other way. Consequently, the improved jet channel as described is rendered incapable of forming air pockets within itself On account of this unique configuration, the head pressure created when the flush cycle is initiated is sufficient to immediately and forcefully traverse the distance from the waterline in the tank, to the surface of the water in the bowl, which distance typically measures fourteen to sixteen inches in conventional toilets.

In another desirable configuration disclosed herein, the abovementioned features and improvements are combined with a simultaneous vacuum mechanism, which helps to pull waste from trapway and the toilet bowl. This overall system creates for a faster delivery of water at a higher head pressure than traditional siphon jet systems. Furthermore, in combining the abovementioned features with a vacuum mechanism a more complete disposal action is achieved.

In yet another desirable configuration disclosed herein, a channel that delivers water to the rim area of the toilet is added to the elements mentioned the previously disclosed configurations, so as to provide bowl wash.

In each disclosed configuration, the use of every named feature is furthermore affected by the one-time user actuation of a single flush valve. The net result is a faster and more efficient system for the disposal of human waste, wherein both water and the associated expense are conserved on a flush-per-flush basis. Yet another advantage to the general system disclosed herein lies in the reduction of toilet maintenance costs, which are mitigated by virtue of the system's employing a smaller number of wear-prone moving parts.

The first of the aforementioned configurations, shown as 100 in FIG. 1, is depicted by a side cutaway view of a toilet 100, per the present invention, in a resting state, ready to be flushed. A primed jet channel 102 remains full on account of an airtight seal created by a closed flush valve 104. An overflow tube 106 further depicts the uniqueness of this configuration, insofar as it fails to connect to either the flush valve 104 or the jet channel 102, as per a conventional toilet. As no air is allowed to enter the jet channel 102, it is rendered incapable of emptying, even after the flush cycle is complete. A continuous fluid connection is furthermore shown between the jet channel 102, an intersection 110 an outflow jet 108 and a tank 112, disrupted only by the water tight flush valve 104. Note that the intersection 110 can occur anywhere along the jetway 102 between the flush valve 104 and the jet exit 108.

Figure 2:
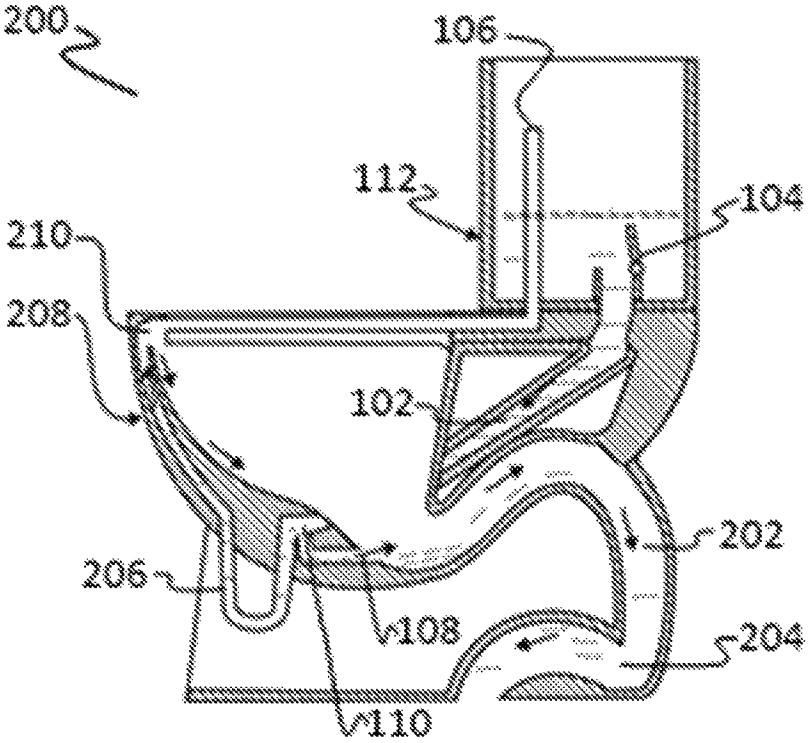
FIG. 2 is a drawing of the same toilet from FIG. 1 during the flushing cycle.

Moving forward, FIG. 2 depicts a side cutaway view of the same configuration 200 of the present invention as depicted in FIG. 1, now shown in the process of flushing. Owing to the continuous fluid connection from the tank 112 through the jet channel 102 to the intersection 110, as soon as the flush valve 104 is opened, water exits from the outflow jet 108, substantially and simultaneously with a user's activation of the flush cycle. The instantaneous injection of water into a trapway 202, created from the primed outflow jet 108, seals off the gap 204, and commences the siphoning effect critical to the performance of all siphon jet type toilets. In addition, water from the intersection 110 is fluidly connected with a rim channel 206. As water races down the jet channel 102 and into intersection 110, it pushes water up and out of the rim channel 206, which rinses down the internal walls of the bowl 208 through a rim channel outlet 210 located along the upper inner edge of the bowl 208, whose function lies in providing rim wash to scour the bowl 208 clean.

Figure 3:
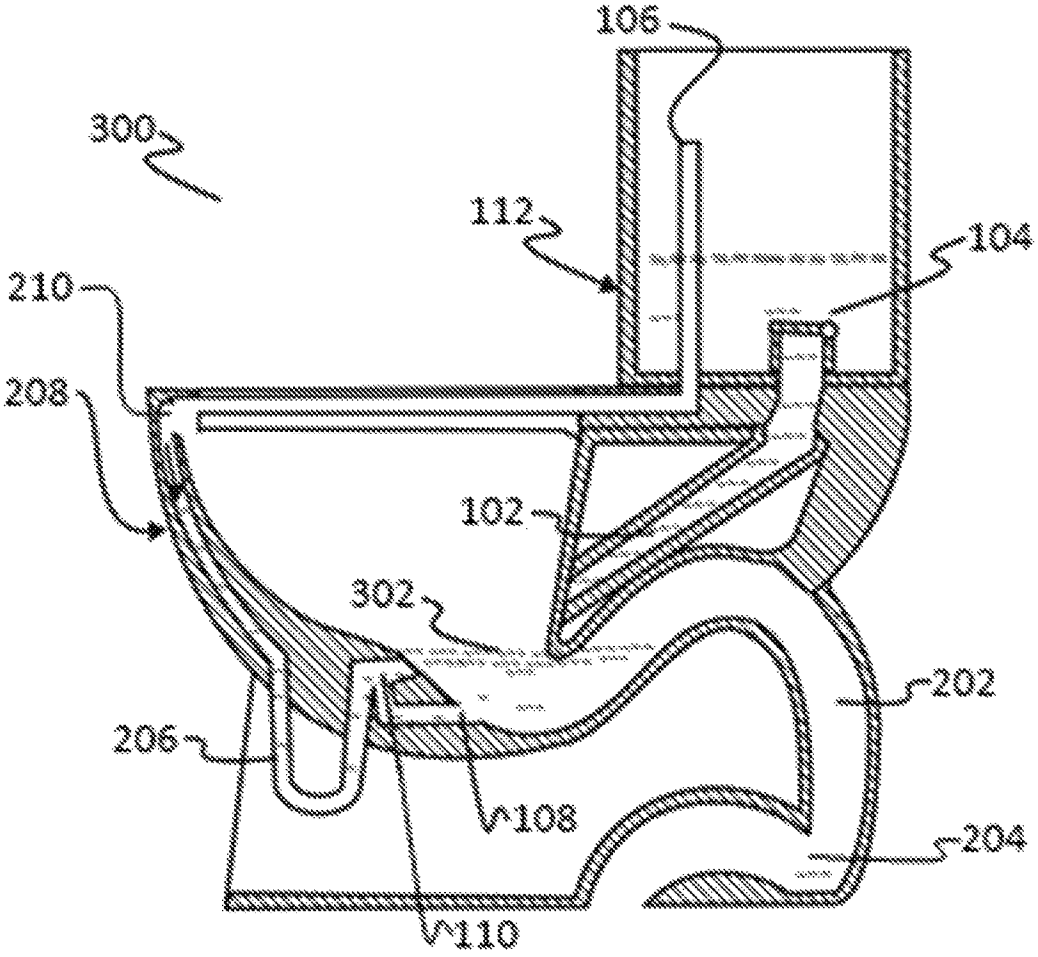
FIG. 3 is a drawing of the same toilet from FIGS. 1 and 2, now wherein the valve is closing at the end of the flushing cycle, and also wherein the siphon breaks and the trapway is emptied prior to the bowl being refilled.

FIG. 3 shows the same configuration 300 as presented by FIGS. 1 and 2, now at the end of the flush cycle. With the closing of the flush valve 104, the flow of water from the jet channel 102 through the intersection 110 is stopped abruptly. This abrupt cessation of flow from the flush valve 104 down the jet channel 102 through the intersection 110, and in turn through the outflow jet 108, occurs while water is still flowing out of the outflow jet 108, and also while water is exiting a bowl reservoir 302, past the opening of the outflow jet 108. Notably, the depicted fill level of the bowl reservoir 302, in this instance, reflects the operating water level of the bowl, which is to say the fill level of the bowl 208 when it is in use.

While these effects are occurring, the concatenation of the forces created by the previously mentioned abrupt cessation of flow causes a pulling action on the jet channel 102. Furthermore, because the rim channel 206 dips below the level of the outflow jet 108, any extra flow that is pulled from the intersection 110 will come from the rim channel 206, which serves as a reservoir to ensure no air enters the jet channel 102. As the rim channel 206 dips below the level of the outflow jet 108, some water remains within it, from which the jet channel 102 can pull, through the intersection 110. This ensures that no air can enter the jet channel 102 in a reverse direction from the rim channel 206, and allows the jet channel 102 to remain substantially filled with water and also free of air. At the end of the flush cycle, all water left in the rim channel 206, positioned above the bowl water level 302, will flow back in the direction of the outflow jet 108, thus raising the water level of the bowl reservoir 302 above the outflow jet 108. This action ensures that air cannot enter the jet channel 102 from the outflow jet 108. The bowl 208 and the tank 112 are then refilled to the desired level through a traditional fill valve, as is well known in the art, which is consequently omitted from the disclosure within this application.

Figure 4:
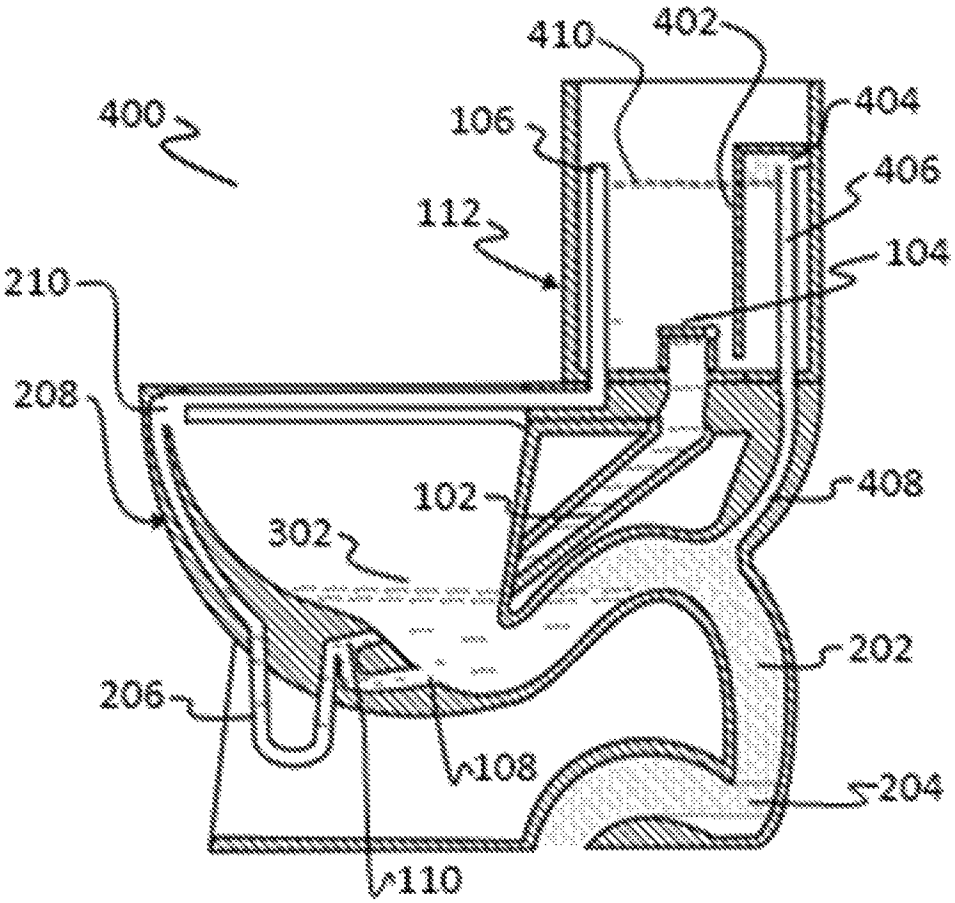
FIG. 4 is a drawing of a toilet, at a resting state between flushes, in a configuration which combines all previously disclosed features of the present invention, now with a vacuum assist apparatus, which is also shown at a resting state.

Yet another configuration of the present invention 400 is presented in FIG. 4, which depicts a side cutaway view of a toilet ready to be flushed. Accordingly, a vacuum container 402 has been added, in order to forcibly augment the actions of the primed jet channel 102 and the rim channel 206. The elements responsible for causing the enhanced vacuum effect upon flushing are shown within, extending downward from, and surrounding the vacuum container. These comprise a differential atmosphere 404, a vacuum tube 406, a vacuum channel 408, and finally, a full tank water level 410. In spite of the fact that a differential atmosphere 404 has been incorporated into the overall system of an "air free" toilet, the primed jet channel 102 remains full, on account of the airtight seal created by the closed flush valve 104. Additionally, there is no open connection between the primed jet channel 102 and the atmosphere, as the overflow tube 106 is not connected to the flush valve 104 or the jet channel 102, as in a conventional toilet. As no air is allowed to enter the jet channel 102, it still remains incapable of emptying, even after the flush cycle is complete. As in previously described configurations, a continuous fluid connection between the outflow jet 108 and the tank 112 is maintained, which flow is disrupted only by the actuation of the water-tight flush valve 104.

One skilled in the art will appreciate that for a vacuum container 402 to help in pulling waste from the bowl 208, the gap 204 must also be sealed off by flushing water so that the trapway 202 becomes isolated from the sewer system. This closing of the gap 204 provides something for the vacuum created in the vacuum container 402 to pull against, thus the quicker the gap 204 can be closed off, isolating the trapway 202, the more efficient the vacuum container 402 can operate, as potential vacuum is not wasted by simply pulling air from the sewer pipes. In operation, the instantaneous feed of water from the jet exit 108, which occurs when the flush valve 104 is activated, helps to close off the gap 204 more quickly than a traditional siphon jet toilet would.

Figure 5:
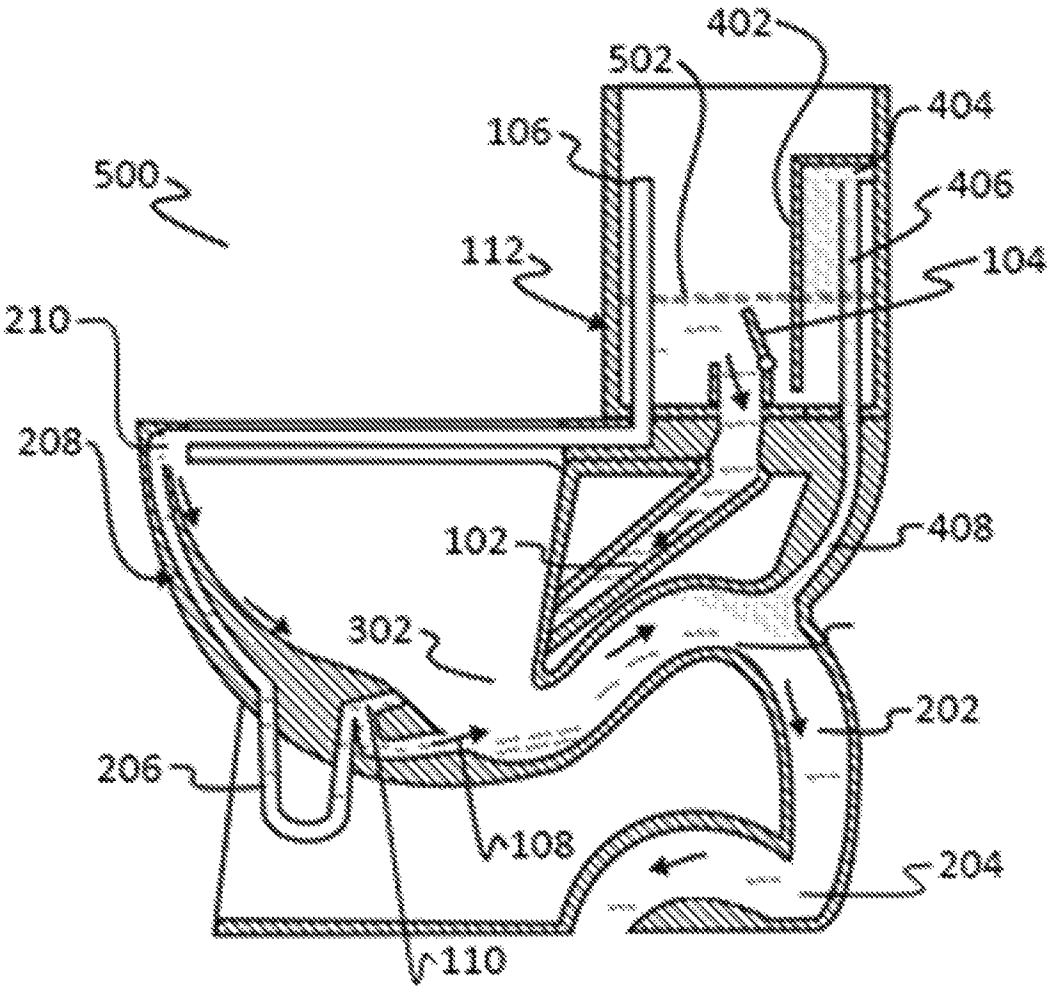
FIG. 5 is a drawing of the same toilet from FIG. 4, now shown as during the flush cycle, with the vacuum assist apparatus also shown now in an activated state.

Moving to a depiction of the use of the vacuum-assisted configuration of the invention, FIG. 5 displays the vacuum container 402, in its operational aspect inside of the tank 112. Accordingly, it is shown that when the water level 502 drops during the flush cycle 500 a vacuum is created inside of the vacuum container 402. This effect is achieved on account of the vacuum tube 406 connecting the differential atmosphere 404 within the container 402 to the trapway 202, Notably, in this configuration, the gap 204 is sealed off by flushing water from the bowl reservoir 302, the jet channel 102, and the intersection 110.

Per a known effect in vacuum-assisted toilets, once the gap 204 is closed, a vacuum can be created in the trapway 202 by a tank-mounted vacuum container 402. In this instance, however, closing the gap 204 and the subsequent creation of a vacuum through the combination of the vacuum container 402 and a primed jet channel 102 is novel and previously untried. The reason for this may be the difficulty inherent to holding tight tolerances when machining ceramic components. For a toilet system to operate with vacuum assistance on a consistent basis has historically required such a level of precision to achieve the closure of the gap 204. Accordingly, vacuum assistance in toilets has been rendered, for the most part, commercially unavailable. However, by combining the instantaneous introduction of water from the outflow jet 108 to the trapway 202, the gap 204 can now be left quite large. The net result of combining all of the features depicted in FIGS. 4 and 5 is a high performance toilet flushing system, which both pushes and pulls waste out of the bowl reservoir 302, and is also readily manufactured.

Figure 6:
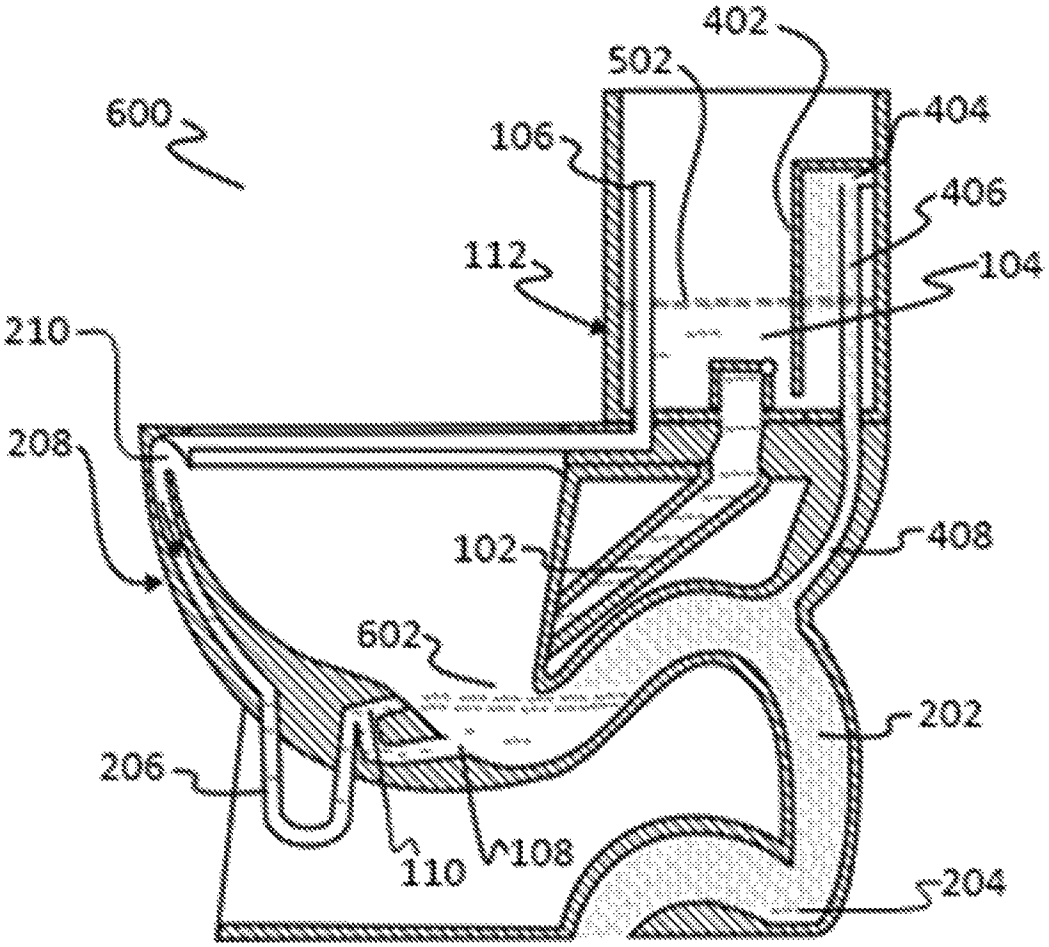
FIG. 6 is a drawing of the toilet as per FIGS. 4 and 5, now shown at the end a the flush cycle, wherein the siphon breaks and the trapway is emptied, prior to the bowl being refilled.

Moving on to the end of the flush cycle, FIG. 6 depicts the same toilet 600 as shown in FIGS. 4 and 5, just prior to the refilling of the bowl 208 and the tank water level 112. As water fills the tank 112, the post-flush water level 502 begins to rise, and both the tank 112 and the vacuum container 402 are refilled, as is bowl 208. In the enhanced configuration shown in FIGS. 4-6, the flushing action is the same as that of the configuration depicted in FIGS. 1-3, with the exception of the addition of vacuum assistance. Accordingly, a small amount of backflow 602 is shown refilling the bowl 208, which results from the action of the jet channel 102 upon closure of the flush valve 104 at the end of the flush cycle.

Figure 7:
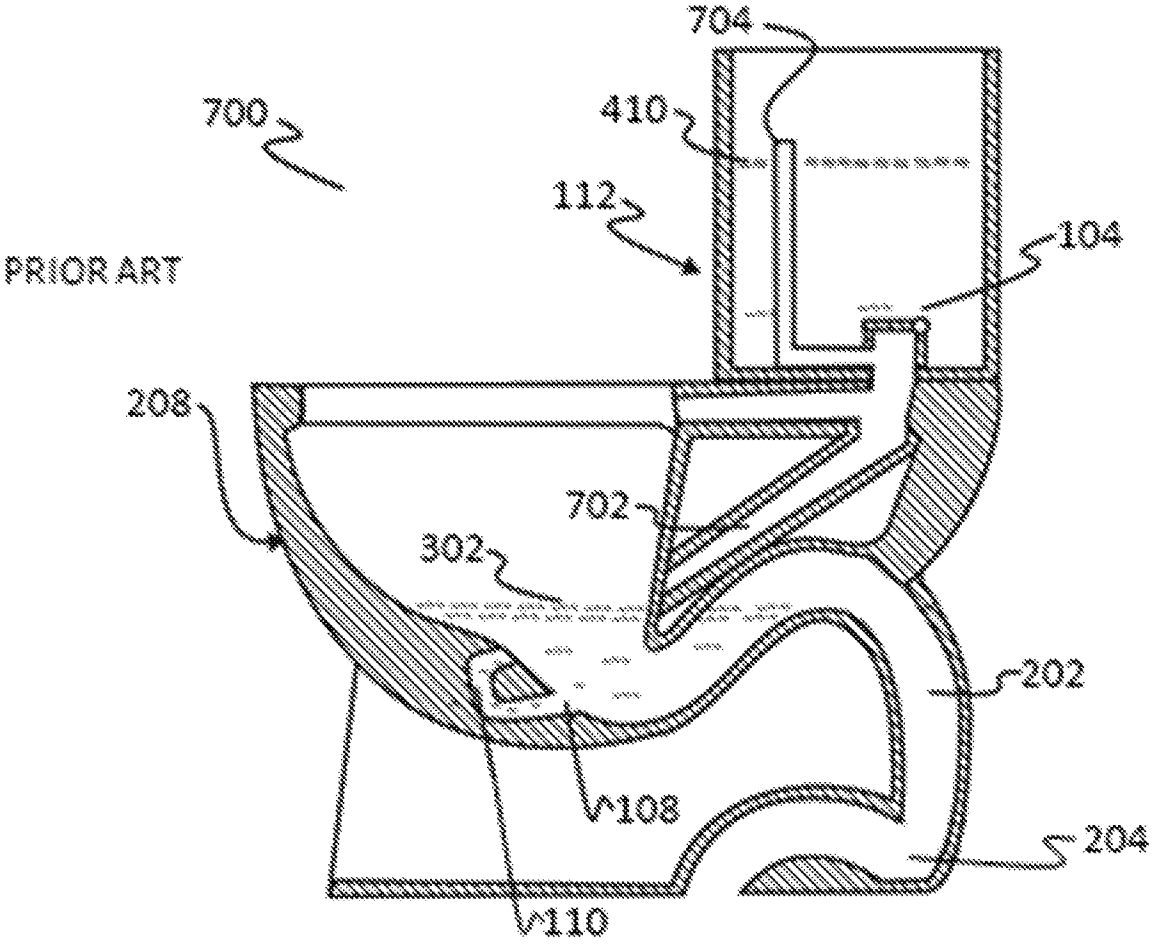
FIG. 7 is a drawing of a conventional toilet, as per the prior art, at rest between flush cycles.

To offer an example of what the present invention is improving upon, FIG. 7 shows a prior art toilet 700 at rest between flush cycles. A standard jet channel 702 is shown connected to the atmosphere through the conventionally routed overflow tube 704. As a result of this configuration, the jet channel 702 contains water only to the level of the bowl reservoir 302, and is filled with air above that level, all the way to the flush valve 104.

Figure 8:
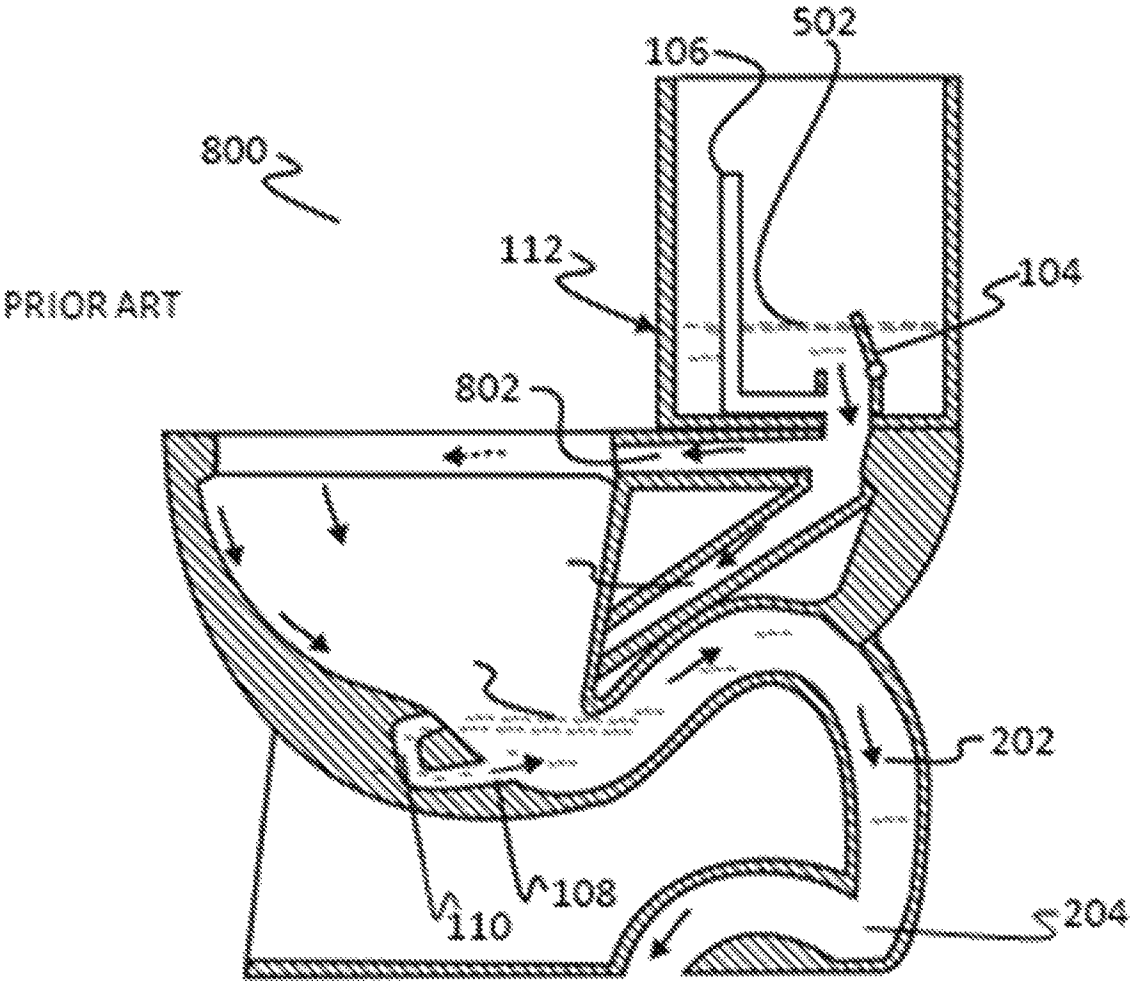
FIG. 8 is a drawing of a conventional toilet, as per the prior art, now shown during the flushing cycle.

Finally, FIG. 8 shows the same prior art toilet 800 as seen in FIG. 7, now depicted during the flush cycle. A flow diagram in arrows depicts the difference between the routing of water through the prior art and the present invention, while the conventionally routed rim channel 802 is shown in its difference from that of the present invention.

The invention presented herein may be embodied as a method for creating a siphon jet toilet by providing the elements disclosed and arranging them as disclosed.

What is claimed is:

1. A siphon jet toilet comprising:

a bowl having a rim and an operating water level;

a jet channel in fluid communication with the bowl and a tank, wherein the jet channel remains filled with flushing fluid both when the toilet is being flushed and when the toilet is at rest;

a rim channel in fluid communication with the jet channel providing fluid therefrom to the upper and inner edge of the bowl, where at least a portion of the rim channel remains full when the toilet is flushed;

an outflow jet having a level and providing fluid to the bowl, wherein the outlfow jet is in fluid communication with the rim channel;

a trapway in fluid communication with bowl allowing affluent to exit therefrom; and a vacuum container in fluid communication with the trapway, where the trapway has a water level, and where the vacuum container is attached with the trapway such that when a flush valve is activated, water simultaneously exits the outflow jet sufficiently to fill the trapway, forming a vacuum seal between the vacuum container and the water in the trapway, pulling from the trapway, wherein the tank stores fluid that is introduced through the flush valve into the jet channel, where the vacuum container resides within the tank.

2. A siphon jet toilet as set forth in claim 1, where a portion of the rim channel travels below the level of the outflow jet.

3. A siphon jet toilet as set forth in claim 1, further comprising an intersection between the jet channel and the rim channel where the intersection always resides below the operating water level of the bowl when the toilet is flushed and when the toilet is at rest.

4. A method for forming a siphon jet toilet comprising steps of of:

forming a bowl having a rim and an operating water level;

forming a jet channel in fluid communication with the bowl and a tank, wherein the jet channel remains filled with flushing fluid both when the toilet is being flushed and when the toilet is at rest;

forming a rim channel in fluid communication with the jet channel providing fluid therefrom to the upper and inner edge of the bowl, where at least a portion of the rim channel remains full when the toilet is flushed;

forming an outflow jet having a level, the outflow jet providing fluid to the bowl and in fluid communication with the rim channel;

forming a trapway in fluid communication with the bowl allowing affluent to exit therefrom; and forming a vacuum container in fluid communication with the trapway, where the trapway has a water level, and where the vacuum container is attached with the trapway such that when a flush valve is activated, water simultaneously exits the outflow jet sufficiently to fill the trapway, forming a vacuum seal between the vacuum container and the water in the trapway, pulling from the trapway, wherein the tank stores fluid that is introduced through the flush valve into the jet channel, where the vacuum container resides within the tank.

5. A method for forming a siphon jet toilet as set forth in claim 4, where a portion of the rim channel is formed to travel below the level of the outflow jet.

6. A method for forming a siphon jet toilet as set forth in claim 4, further comprising an act of forming an intersection between the jet channel and the rim channel where the intersection always resides below the operating water level of the bowl when the toilet is flushed and when the toilet is at rest.

7. A siphon jet toilet comprising a bowl having a rim and an operating water level;

a jet channel in fluid communication with the bowl and a tank, wherein the jet channel remains filled with flushing fluid both when the toilet is being flushed and when the toilet is at rest;

a rim channel in fluid communication with the jet channel providing fluid therefrom to the upper and inner edge of the bowl, where at least a portion of the rim channel remains full when the toilet is flushed; and a flush valve connected with the jet channel for opening and closing the jet channel to the tank, where the flush valve resides within the tank, where when the toilet is flushed, the flush valve opens to permit the flow of water from the tank into the jet channel, with the rim channel configured such that when the flush valve closes, water remaining in the rim channel above the operating water level of the bowl will flow back toward the jet channel to further ensure that air does not enter the jet channel at the end of a flush cycle.

8. A method for forming a siphon jet toilet comprising acts of forming a bowl having a rim and an operating water level;

forming a jet channel in fluid communication with the bowl and a tank, wherein the jet channel remains filled with flushing fluid both when the toilet is being, flushed and when the toilet is at rest;

forming a rim channel in fluid communication with the jet channel, providing fluid therefrom to the upper and inner edge of the bowl, where at least a portion of the rim channel remains full when the toilet is flushed;

forming a flush valve connected with the jet channel for opening and closing the jet channel to the tank, where the flush valve resides within the tank, where when the toilet is flushed, the flush valve opens to permit the flow of water from the tank into the jet channel, with the rim channel configured such that when the flush valve closes, water remaining in the rim channel above the operating water level of the bowl will flow back toward the jet channel to further ensure that air does not enter the jet channel at the end of a flush cycle.

* * * * *